US005697011A

United States Patent [19]

Kobayashi et al.

[11] Patent Number: 5,697,011

[45] Date of Patent: Dec. 9, 1997

[54] IMAGE FORMING APPARATUS AND A DENSITY MEASURING METHOD IN WHICH A DENSITY MEASURING MODE IS CHANGED IN ACCORDANCE WITH A DEVELOPED IMAGE

[75] Inventors: Tatsuya Kobayashi, Souka; Akihiko Uchiyama, Yokohama, both of Japan

[73] Assignee: Canon Kabushiki Kaisha, Tokyo, Japan

[21] Appl. No.: 357,328

[22] Filed: Dec. 16, 1994

[30] Foreign Application Priority Data

Dec. 27, 1993 [JP] Japan ..... 5-348809

[51] Int. Cl.[6] ..... G03G 15/00; G03G 15/08

[52] U.S. Cl. ..... 399/49; 399/74

[58] Field of Search ..... 355/245, 246; 399/49, 73, 74

[56] References Cited

U.S. PATENT DOCUMENTS 4,952,986 8/1990 Maeda et al. ..... 355/246 X 5,107,302 4/1992 Bisaiji ..... 355/246

5,119,132 6/1992 Butler ..... 355/246 X 5,245,390 9/1993 Ishigaki et al. ..... 355/246

5,353,103 10/1994 Okamoto et al. ..... 355/246

*Primary Examiner*—Fred L. Braun

*Attorney, Agent, or Firm*—Fitzpatrick, Cella, Harper & Scinto

[57] ABSTRACT

An image forming apparatus includes an image bearing member for bearing an electrostatic image, a plurality of developing units for accommodating developers having different colors, a light source for projecting light onto a developed image, and a photosensor for sensing reflected light from the developed image. The apparatus operates in either a first mode for determining the density of the developed image based on the output of the photosensor when light having a predetermined amount is projected from the light source, or in a second mode for determining the density of the developed image based on the amount of light projected from the light source when the output of the photosensor has a predetermined value. Either the first mode or the second mode is selected in accordance with the color of a developer being utilized during the image formation operation.

12 Claims, 9 Drawing Sheets

IMAGE FORMING APPARATUS AND A DENSITY MEASURING METHOD IN WHICH A DENSITY MEASURING MODE IS CHANGED IN ACCORDANCE WITH A DEVELOPED IMAGE

BACKGROUND OF THE INVENTION

1. Field of the Invention

This invention relates to a density measuring method, and an image forming apparatus, such as an electrophotographic apparatus, an electrostatic recording apparatus or the like, in which the density of a developed image is measured.

2. Description of the Related Art

FIG. 7 is a cross-sectional view of a density measuring apparatus for measuring the density of an image. In FIG. 7, a density measuring sensor 100 includes an LED (light-emitting diode) 102, serving as a light-emitting device, and a photodiode 103, serving as a photosensor, within a holder 101. The LED 102 is controlled so as to emit a constant amount of light, which is projected onto an image 104 to be measured on an image bearing member 1. Light reflected by the image 104 having an intensity corresponding to the density of the image enters the photodiode 103. A current proportional to the incident amount of light is created in the photodiode 103. The current is converted into a voltage by an operational amplifier (not shown) and is output. The obtained output is converted into a digital signal by a D/A (digital-to-analog) converter (not shown), and is subjected to succeeding processing.

FIG. 8 is a cross-sectional view of an image forming appartus which uses the density measuring sensor 100 shown in FIG. 7.

In FIG. 8, a photosensitive drum 1, serving as an image bearing member, uniformly charged by a charger 2 is exposed in accordance with an input image signal by an exposure apparatus 3, so that an electrostatic latent image is formed on the photosensitive drum 1. Then, the latent image is developed by a developing unit 4 which consists of developing unit **4*a* containing a black toner and developing unit 4*b* containing a red toner which are selectively used to create a toner image. The visible toner image on the photosensitive drum 1 is transferred onto a transfer material 10 by a transfer roller 6. The transferred image is fixed by a fixing unit 8, whereby a permanent image is obtained. Untransferred toner particles remaining on the photosensitive drum 1 are cleaned by a cleaner 7, and the cleaned photosensitive drum 1 is used for the next image forming processing. Reference numeral 100 represents a density sensor having the same configuration as that shown in FIG. 7. The density sensor 100 detects the density of the toner image on the photosensitive drum 1, transmits the result of the detection to a CPU (central processing unit, now shown), and controls, as is generally known, the charged potential of the photosensitive drum 1 by the charger 2, the emission intensity of the exposure apparatus 3**, the bias voltage for development and the like, in order to stabilize the obtained image.

FIG. 9 illustrates changes in outputs when an LED having a wavelength of 950 nm is used, and the density of a black toner and the density of a red toner are changed. In FIG. 9, the output for the background portion of the photosensitive drum on which toner particles are absent corresponds to 2.5 V. As is apparent from FIG. 9, in the case of the black toner, the output decreases as the density increases. In the case of the red toner, however, the output increases as the density increases. As a result, in the case of the black toner, the output changes between 0–2.5 V. In the case of the red toner, the output changes between 2.5 V–5 V. Reverse characteristics are obtained for the two toners, because the black toner absorbs light projected from the density sensor, but the red toner reflects the light.

In the above-described density measuring method, in the case of the red toner, the amount of reflected light sufficiently changes and therefore can be measured within a range of density values between 0 and 2 which correspond to the practially used range. In the case of the black toner, however, the amount of reflected light changes little for density values equal to or greater than 1.0 (a region A in FIG. 9), and therefore the density cannot be precisely measured.

SUMMARY OF THE INVENTION

It is an object of the present invention to provide a density measuring method which can very precisely measure the density of an object to be measured irrespective of the color of the object.

It is another object of the present invention to provide an image forming apparatus which can very precisely measure the density of an object to be measured irrespective of the color of a developer.

According to one aspect, the present invention, which achieves these objectives, relates to an image forming apparatus, comprising an image bearing member for bearing an electrostatic image, developing means for developing the electrostatic image on the image bearing member, and density measuring means for measuring the density of the image developed by the developing means. The density measuring means comprises a light source for projecting light onto the developed image, and a photosensor for sensing reflected light from the developed image. The density measuring means can have a first mode of determining the density based on the output of the photosensor when light having a predetermined amount is projected from the light source, and a second mode of determining the density based on the amount of light projected from the light source when the output of the photosensor has a predetermined value.

According to another aspect, the present invention relates to a density measuring method, comprising the steps of projecting light from a light source onto an object to be measured, sensing light reflected by the object by a photosensor, and selecting a first mode of determining the density of the object based on the output of the photosensor when light having a predetermined amount is projected from the light source, and a second mode of determining the density of the object based on the amount of light projected from the light source when the output of the photosensor has a predetermined value.

The foregoing and other objects, advantages and features of the present invention will become more apparent from the following description of the preferred embodiments taken in conjuction with the accompanying drawings.

DESCRIPTION OF THE PREFERRED EMBODIMENTS

Figure 1:
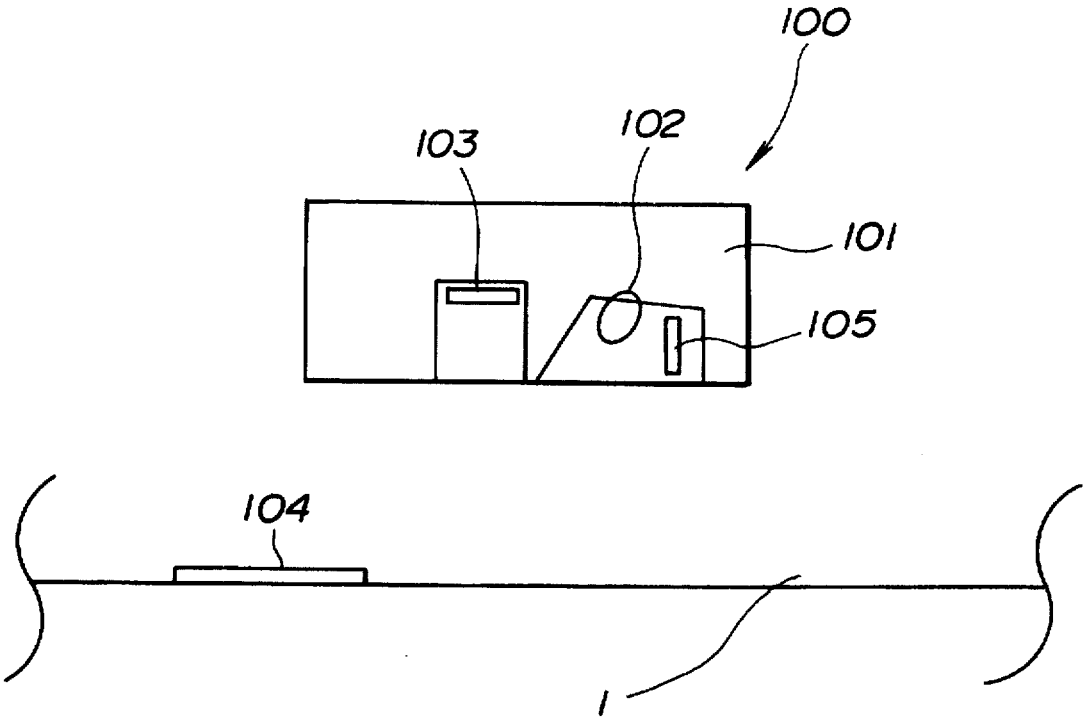
FIG. 1 is a schematic diagram illustrating the configuration of a density measuring apparatus according to a first embodiment of the present invention.

Preferred embodiments of the present invention will now be described with reference to the drawings.

In the drawings, the same components as those shown in the description of the related art are indicated by the same reference numerals, and an explanation thereof will be omitted.

FIG. 1 is a cross-sectional view of a density measuring apparatus according to a first embodiment of the present invention.

In FIG. 1, a density sensor 100, serving as the density measuring apparatus, includes an LED 102, serving as a light source, a photodiode 105, serving as a second photosensor for directly sensing light emitted from the LED 102 to measure the amount of the light, and a photodiode 103, serving as a photosensor for measuring reflected light from an image 104, whose density is to be measured, within a holder 101.

In the density sensor 100 of the present embodiment, the density measuring mode can be switched between a first mode of sensing reflected light from the image 104 when light having a predetermined amount is projected from the LED 102 thereon by the photodiode 103, and measuring the density of the image 104 based on the output of the photodiode 103, and a second mode of controlling the amount of illuminating light from the LED 102 so that the output of the photodiode 103 has a predetermined value, sensing the amount of light from the LED 102 at that time by the photodiode 105, and measuring the density of the image 104 based on the output of the photodiode 105.

Figure 2:
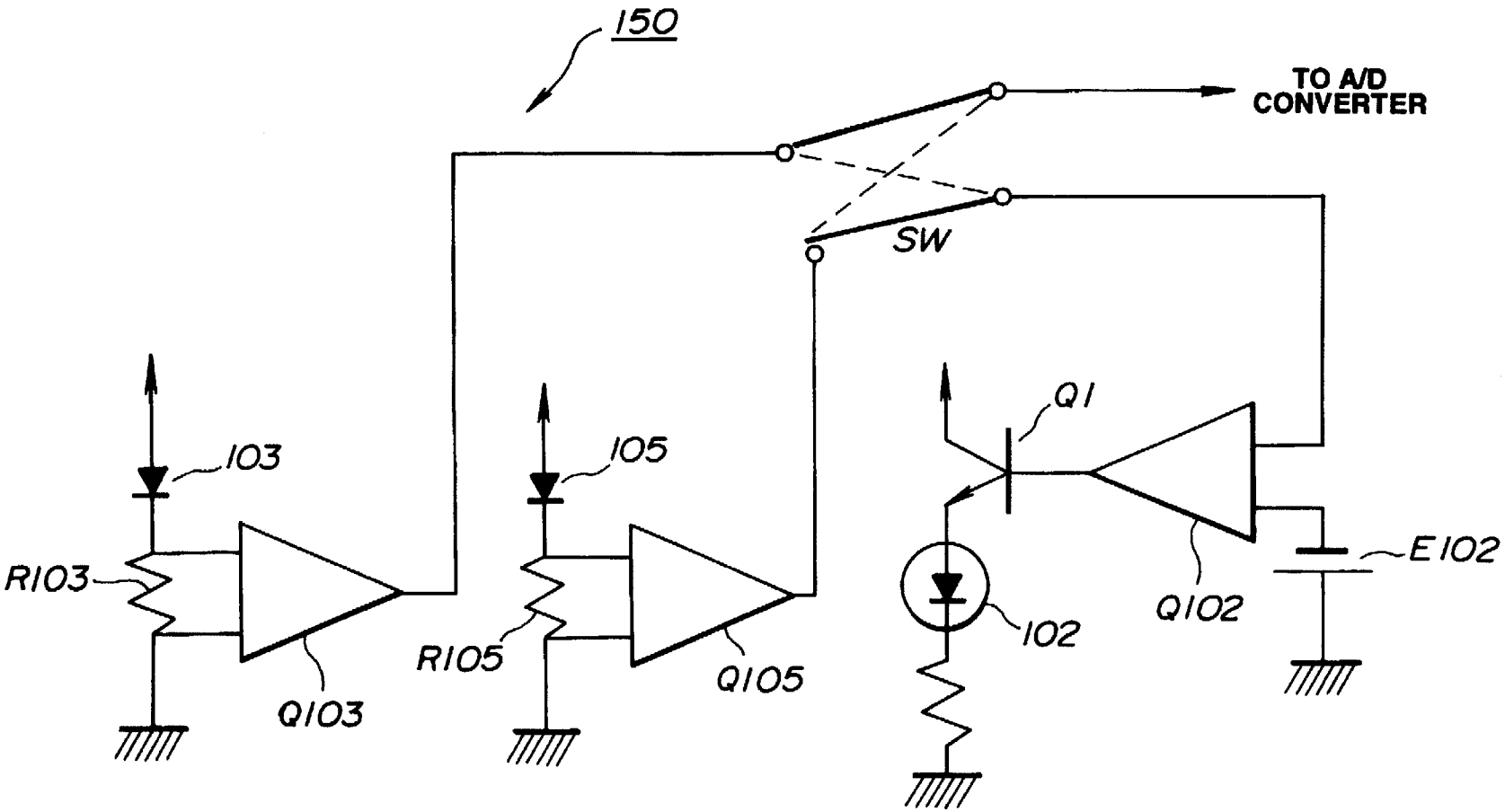
FIG. 2 is a diagram illustrating an equivalent circuit of the apparatus shown in FIG. 1.

FIG. 2 is a diagram illustrating an equalizing circuit 150 for density measurement of the apparatus shown in FIG. 1.

In FIG. 2, the amount of light emitted from the LED 102 can be changed by controlling the current flowing therethrough by a signal input to a transistor Q1. Currents flowing through the photodiodes 103 and 105 are converted into voltages by resistors R103 and R105, and the voltages are amplified by operational amplifiers Q103 and Q105, respectively. The state of a switch SW indicated by solid lines represents the above-described first mode. At that time, the amount of light emitted from the LED 102 is controlled by the output of the photodiode 105 which directly senses the light from the LED 102. That is, a signal from the operational amplifier Q105, which has amplified the output of the photodiode 105, is input to an operational amplifier Q102 which amplifies the difference between this signal and a reference voltage E102, and the amount of light emitted from the LED 102 is controlled to a constant value so that the output of the photodiode 105 equals the reference voltage E102. A signal from the photodiode 103 is transmitted to an A/D converter (not shown) via the operational amplifier Q103 and the switch SW as a signal representing the density of the image, and is subjected to succeeding processing based on the density of the image.

The state of the switch SW indicated by broken lines represents the above-described second mode. In this mode, the signal from the photodiode 103 is transmitted to the operational amplifier Q102 for performing differential amplification, and the LED 102 is controlled so that the output of the photodiode 103 has a constant value. That is, the amount of illuminating light from the LED 102 is changed so that the amount of reflected light from the image has a constant value. At that time, the output of the photodiode 105 is transmitted to the A/D converter via the switch SW as a signal representing the density of the image, and is subjected to succeeding processing based on the density of the image.

Figure 8:
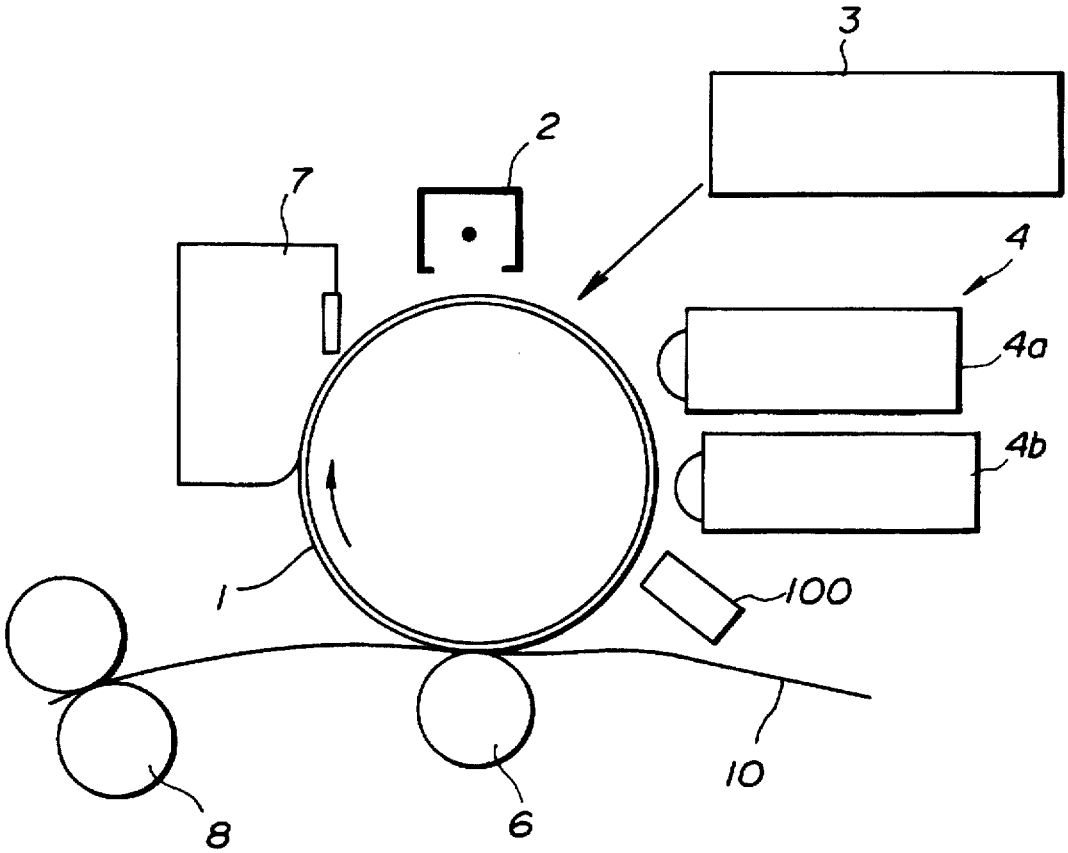
FIG. 8 is a schematic diagram illustrating the configuration of a conventional image forming apparatus.
Figure 9:
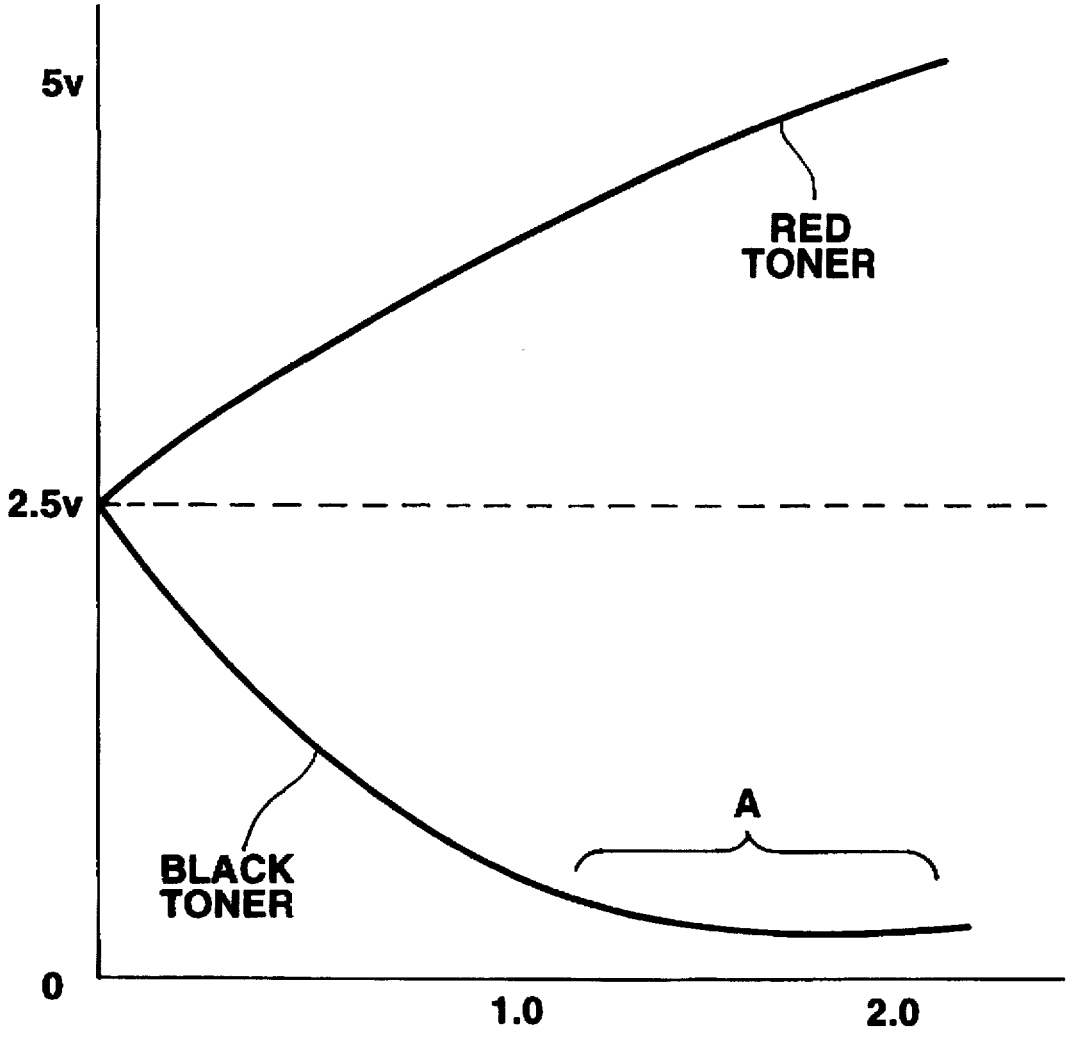
FIG. 9 is a graph illustrating characteristics of the conventional density measuring apparatus shown in FIG. 7.

The densities of reference images formed by a black toner and a red toner on the photosensitive drum for bearing an electrostatic image of the image forming apparatus shown in FIG. 8 were measured using the density sensor 100 shown in FIGS. 1 and 2.

Figure 3:
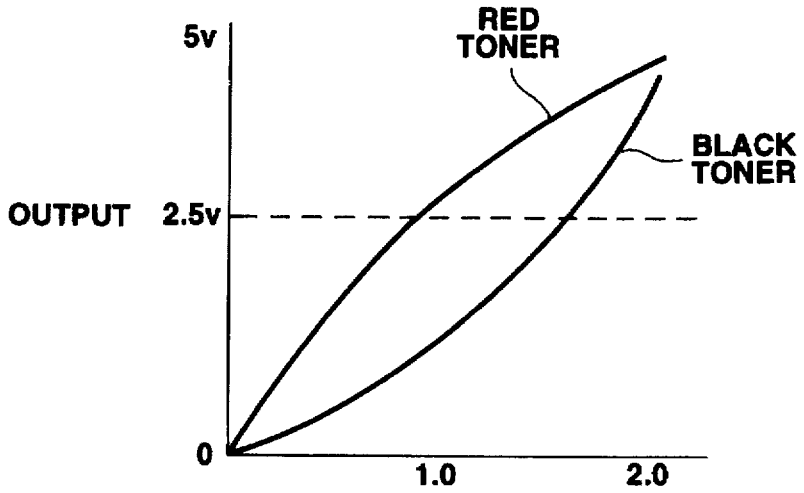
FIGS. 3(1) through 3(3) are graphs illustrating characteristics of the apparatus shown in FIGS. 1 and 2.
Figure 3:
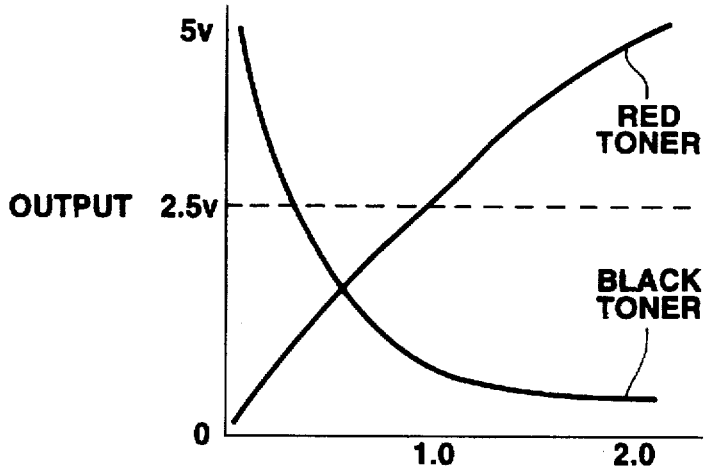
Figure 3:
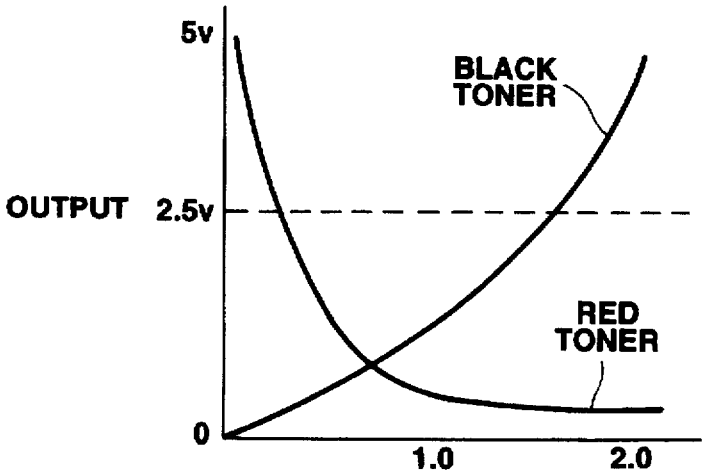

FIGS. 3(1) through 3(3) illustrate the results of the measurement. In FIGS. 3(1) through 3(3), the abscissa represents the optical density of each of black and red images, and the ordinate represents the output of the density sensor. In the present embodiment, the density is measured in the second mode for the black toner, and in the first mode for the red toner. The results of the measurement are shown in FIG. 3(1). As comparative examples, FIG. 3(2) illustrates a case in which the density was measured in the first mode for both the black toner and the red toner, and FIG. 3(3) illustrates a case in which the density was measured in the second mode for both the black toner and the red toner.

As is apparent from FIG. 3(1), according to the present embodiment, sufficient changes in the outputs can be obtained even at high-density regions where the optical density exceeds 1.0 for both the black toner and the red toner, and therefore the density can be precisely measured. The output increases as the toner density increases for both the black toner and the red toner.

Accordingly, the full range of the A/D converter can be used, and therefore wider changes in the output can be obtained. To the contrary, changes in the output for the black toner are small at densities exceeding 1.0 in the case of FIG. 3(2), and changes in the output for the red toner are small at densities exceeding 1.0 in the case of FIG. 3(3).

Based on the density very precisely measured in the above-described manner, in the image forming apparatus shown in FIG. 8, image forming conditions, such as the amount of charging, the amount of exposure, the bias potential in development, and the like, are controlled, and the supply of toner particles to the developing unit is controlled.

Although in the present embodiment a description has been provided of the case of measuring the amount of light emitted from the LED 102 by the photodiode 105, the amount of light emitted from the LED 102 may be measured by any other method, for example, by measuring the current flowing through the LED 102.

Next, a description will be provided of a second embodiment of the present invention.

Figure 4:
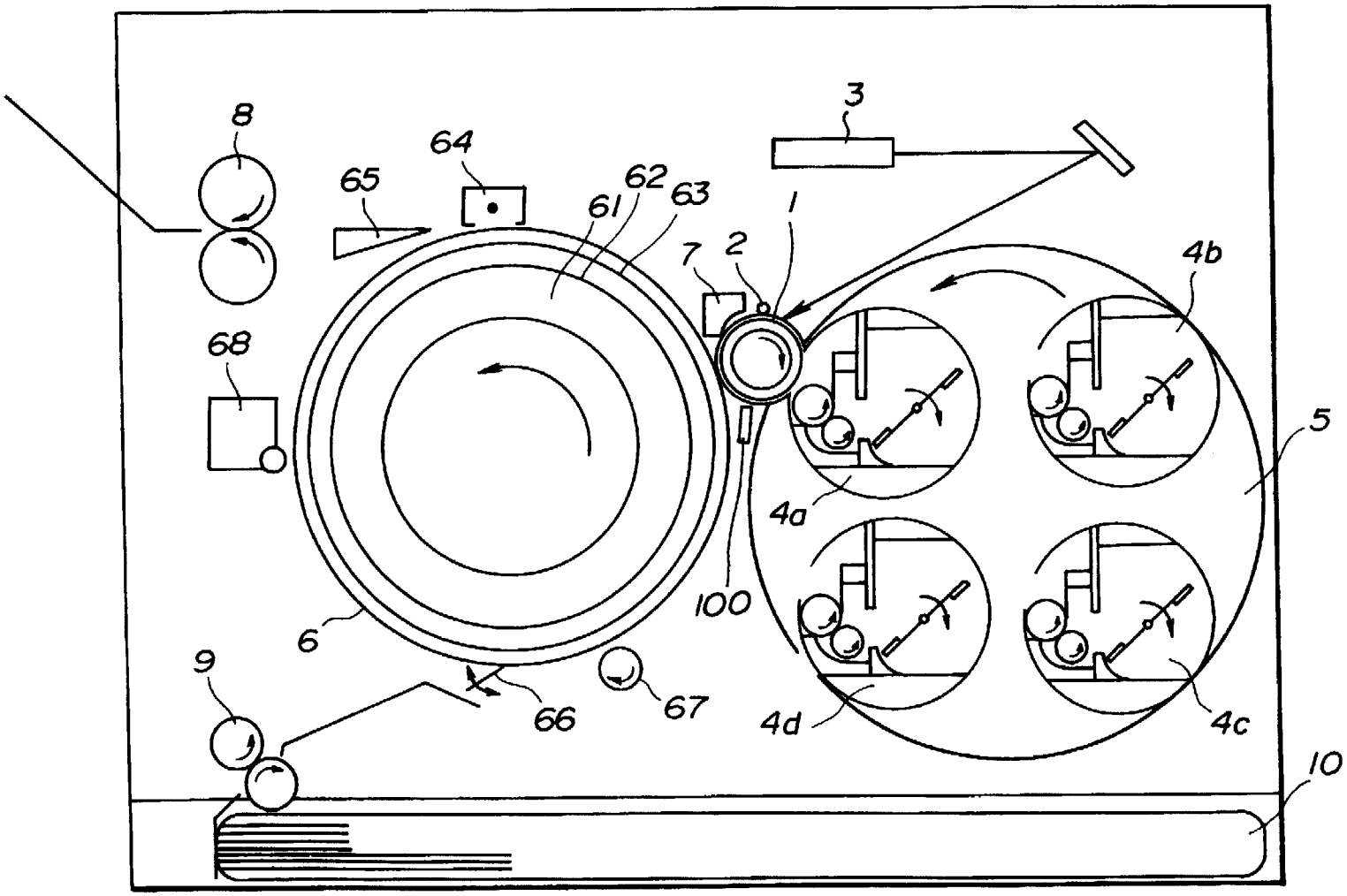
FIG. 4 is a diagram illustrating an image forming apparatus according to a second embodiment of the present invention.

FIG. 4 illustrates an image forming apparatus for obtaining a full-color image according to the second embodiment. A description will now be provided with reference to FIG. 4. A photosensitive drum 1, serving as an image bearing member, comprising a photoconductive material, such as an organic photoconductor (OPC), A (amorphous)-Si, CdS, Se or the like, coated on the outer circumferential surface of an aluminum cylinder, is driven in the direction of the arrow by driving means (not shown), and is uniformly charged to a predetermined potential by a charging roller 2 (to be described later). Then, a signal corresponding to the pattern of an yellow image is input to an exposure apparatus 3, and light corresponding to the signal is projected onto the photosensitive drum 1, whereby a latent image is formed on the photosensitive drum 1. When the photosensitive drum 1 has been further driven in the direction of the arrow, a supporting member 5 rotates so that a developing unit 4*a* containing a yellow toner from among developing units 4*a*, 4*b*, 4*c* and 4*d* supported by the supporting member 5 faces the photosensitive drum 1, and the latent image is visualized by the selected developing unit 4*a*. The developed toner image is transferred onto transfer paper.

The transfer process will now be described in detail. A sheet of transfer paper is fed from within a transfer-paper cassette 10 by a pickup roller 9 in synchronization with the image on the photosensitive drum 1. A transfer drum 6 comprises an elastic layer and a dielectric layer formed on a conductive supporting member, and is rotated in the direction of the arrow at substantially the same speed as the photosensitive drum 1. When the transfer paper has been supplied to the transfer drum 6, the transfer paper (not shown) is held by a gripper 66 provided on a portion of the supporting member and is attracted by an attracting roller. Thereafter, the toner image on the photosensitive drum 1 is transferred onto the transfer paper by applying a bias voltage to the supporting member.

By repeating the above-described processing for a magenta image, a cyan image and a black image, a toner image made of a plurality of color images is formed on the transfer paper. The transfer paper having the final toner image is separated from the transfer drum 6 by a separation pawl 65 after passing through a separation charger 64, and is then conveyed by conveying means, and a full-color image is obtained by fusing and mixing the plurality of toner images by a known heating/pressing fixing unit 8.

Toner particles remaining on the photosensitive drum 1 after the image transfer are cleaned by a cleaning device 7 comprising known blade means. It is desirable to also clean toner particles remaining on the transfer drum 6 by a transfer-drum cleaning device 68, comprising a fur brush, a web or the like, whenever necessary.

In the above-described image forming apparatus, before performing an ordinary image forming operation, the density of an image 104 for density measurement formed on the photosensitive drum 1 is measured by a density sensor 100, and various process conditions, such as the charged potential of the photosensitive drum 1, the amount of light of the exposure apparatus 3, the bias potential for development, and the like, are controlled based on the result of the measurement. Since the density sensor 100 has the same configuration as that shown in FIGS. 1 and 2, a description thereof will be omitted.

Next, a description will be provided of a density measuring operation. The pattern of the image 104 for density measurement is exposed on the photosensitive drum 1 charged by the charging roller 2 by the exposure apparatus 3, whereby a latent image is formed. The latent image is developed by the developing unit 4*a* containing a magenta toner, serving as a first color, whereby a visual toner image is formed. It is preferable to provide a plurality of images 104 for density measurement by changing process conditions, such as the charged potential, the exposure intensity, the bias potential for development, the bias potential for image transfer, and the like, in order to realize better image control. Then, toner images for density measurement, i.e., a cyan image, serving as a second image, a yellow image, serving as a third image, and a black image, serving as a fourth image, are formed in the above-described manner. If the size of the image 104 for density measurement is too small, exact measurement cannot be performed. If the size of the image 104 for measurement is too large, an image forming material, such as a toner or the like, is wastefully consumed. Hence, the size of the image 104 for density measurement is preferably between about 5 mm×5 mm and 20 mm×20 mm.

In the above-described density measurement, magenta, cyan and yellow toners reflect the light of the used LED having a wavelength of 950 nm. Hence, the density of the image is measured in the first mode, in which the amount of light of the LED is made constant, and reflected light from the image is used to produce a signal. On the other hand, a black toner absorbs the light having the wavelength of 950 nm. Hence, the density of the image is measured in the second mode, in which the amount of reflected light from the image for density measurement is made constant, the amount of light from the LED is used to produce a signal.

Although a description has been provided of a case of using infrared light having a wavelength of 950 nm as the light source for the density sensor, a light source having any other wavelength may also be used. In such a case, the mode may be selected depending on whether a used toner reflects or absorbs the light from the light source.

Figure 5:
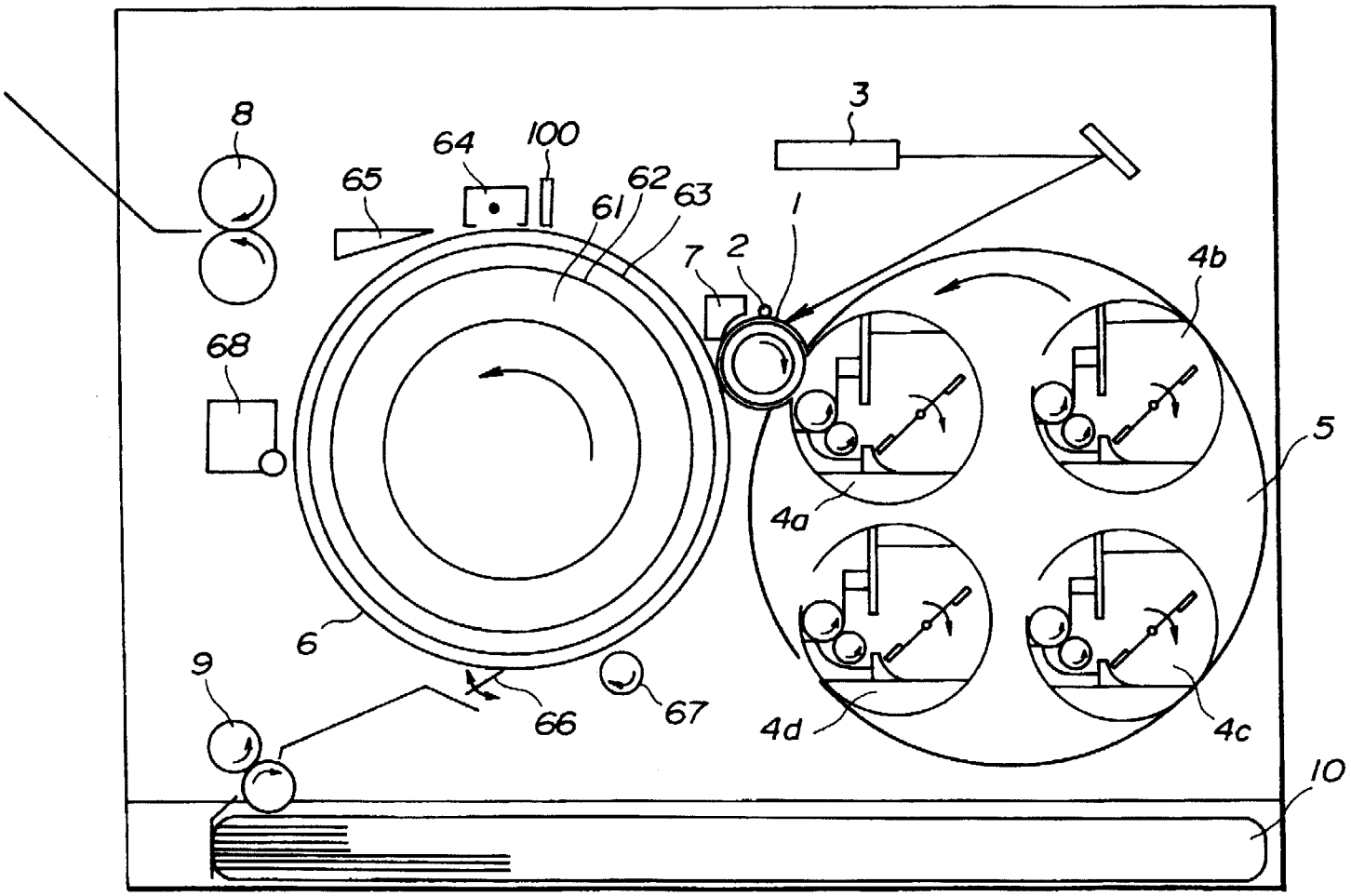
FIG. 5 is a diagram illustrating an image forming apparatus according to a third embodiment of the present invention.
Figure 6:
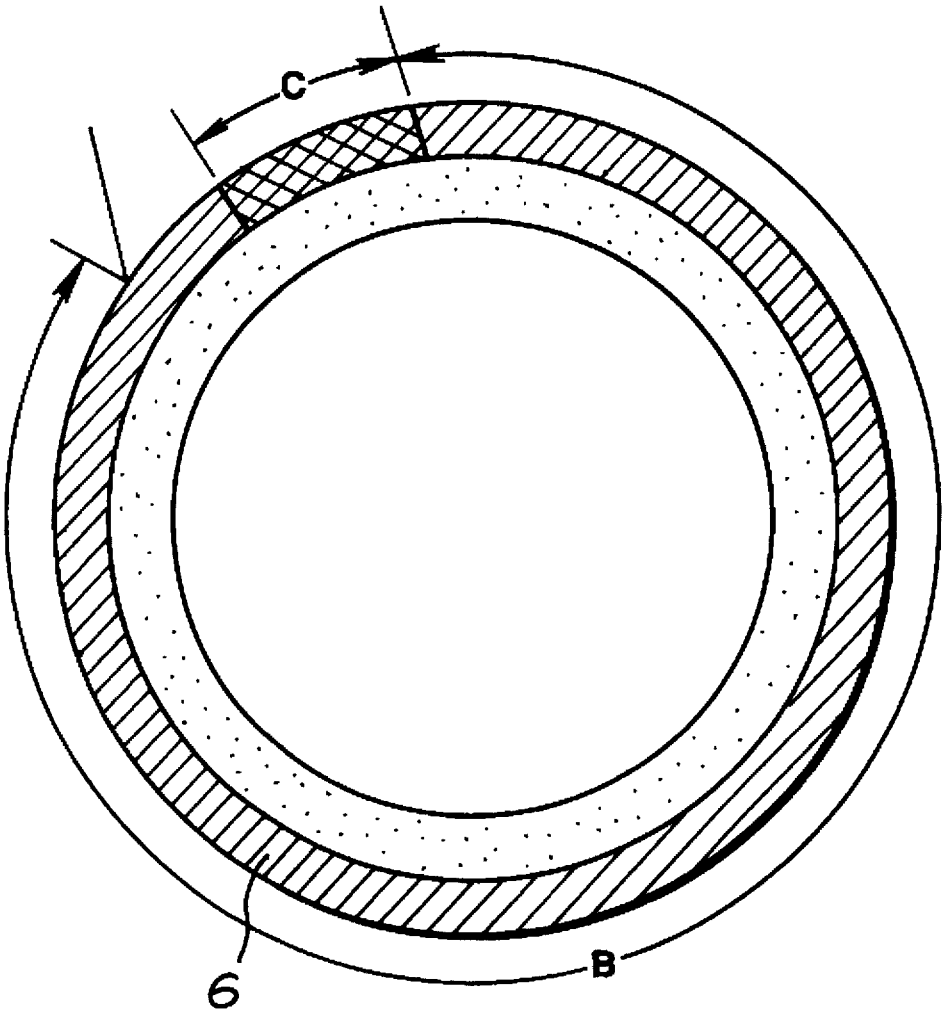
FIG. 6 is a diagram illustrating a transfer drum of the apparatus shown in FIG. 5.
Figure 7:
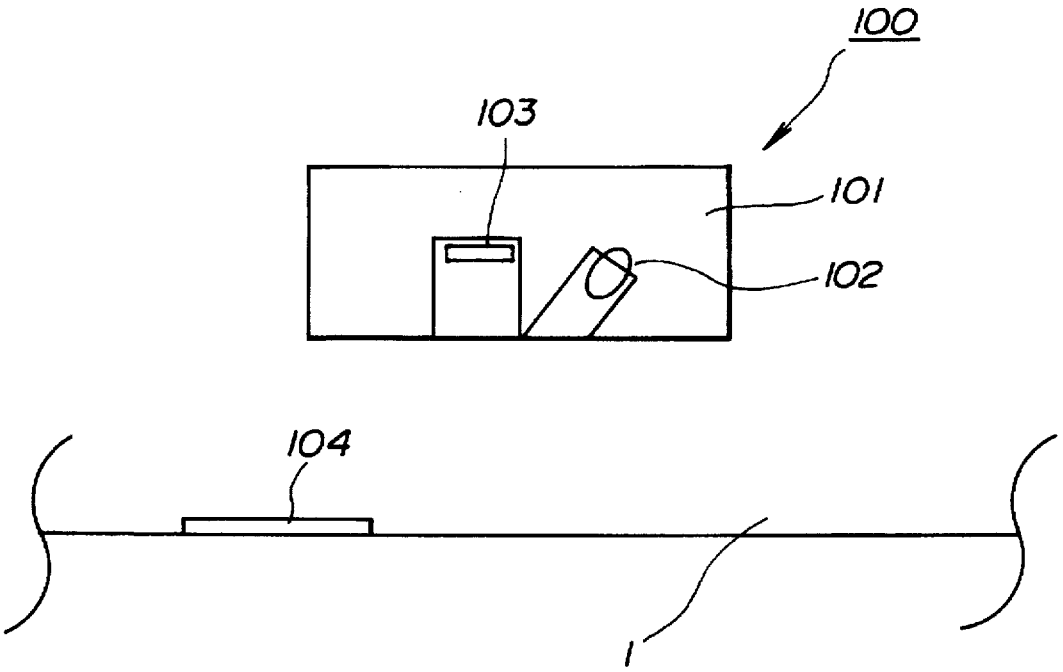
FIG. 7 is a schematic diagram illustrating the configuration of a conventional density measuring apparatus.

FIG. 5 illustrates an image forming apparatus according to a third embodiment of the present invention. The present embodiment has a feature in that an image for density measurement is formed on a transfer drum, and the density of the image is measured by a density sensor. A description will now be provided with reference to FIG. 5. In FIG. 5, components having the same configurations and functions as those shown in the second embodiment are indicated by the same reference numerals, and a description thereof will be omitted. FIG. 6 illustrates a transfer drum 6, in which the density of the obtained image differs between a region B where magenta, cyan and yellow images are transferred, and a region C where a black image is transferred.

This will be described in greater detail below. For magenta, cyan and yellow toners which reflect light for measurement, it is preferable that the transfer drum 6, serving as a background for the toner, absorbs the light for measurement as much as possible, because greater changes in the measurement output can be obtained. Hence, the region B is black. Carbon black or the like having a small secular change is preferable as a black material. On the other hand, it is preferable that in the region C, to which a black toner is transferred, the transfer drum 6, serving as a background for the toner, reflects the light for measurement as much as possible. A pigment, such as barium sulfate or the like, white PTFE (polytetrafluoroethylene), neutral paper, or the like is preferable as a reflecting material. According to the present embodiment, the surface of the transfer drum can be set to an optimum density in accordance with each toner, so that accuracy in measurement is improved. In addition, since an image for measurement after image transfer is used, transfer conditions can be controlled, and a more stable image can be obtained.

Although a description has been provided of a color image forming apparatus using a transfer drum, the present invention is not limited to such an apparatus. For example, the present invention may be applied to a method of developing a plurality of toner images on a photosensitive drum and transferring the obtained multiple images onto transfer paper at a time, and to a method of transferring a plurality of toner images onto an intermediate transfer member and transferring the obtained multiple images at a time. In these methods, the densities of toner images on the photosensitive drum, the intermediate transfer member and the transfer paper may be measured.

The individual components shown in outline in the drawings are all well known in the image forming apparatus and density measuring method arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image bearing member for bearing an electrostatic image;

developing means for developing the electrostatic image borne on said image bearing member so as to produce a developed image;

density measuring means for measuring a density of the developed image, said density measuring means comprising a light source for projecting light onto the developed image, and a photosensor for sensing reflected light from the developed image, and said density measuring means having two operational modes including a first mode for determining the density of the developed image based on an output of said photosensor when a predetermined amount of light is projected from said light source, and a second mode for determining the density of the developed image based on an amount of light projected from said light source when the amount of light is controlled so that the output of the photosensor has a predetermined value; and selecting means for selecting one of the first mode and the second mode of the density measuring means.

2. An apparatus according to claim 1, wherein said developing means comprises a plurality of developing units accommodating developers having different colors; and wherein either the first mode or the second mode is selected in accordance with a color of a developer used by a developing unit.

3. An apparatus according to claim 1, wherein the second mode is selected when a developer used by the developing means to develop the electrostatic image is black, and the first mode is selected when the developer is a color other than black.

4. An apparatus according to claim 1, wherein said light source comprises a light-emitting diode.

5. An apparatus according to claim 1, wherein said density measuring means measures the density of a developer used to form the developed image on said image bearing member.

6. An apparatus according to claim 1, wherein said apparatus controls image forming conditions based on the density of the developed image measured by said density measuring means.

7. An apparatus according to claim 1, wherein said apparatus supplies said developing means with a developer with which to develop the electrostatic image based on the density of the developed image measured by said density measuring means.

8. An apparatus according to claim 1, wherein said density measuring means comprises a direct sensing member for directly sensing the light from said light source, and determines the density of the developed image based on an output of said direct sensing member in the second mode.

9. A density measuring method comprising the steps of:

projecting light from a light source onto an image having a density which is to be measured;

sensing light reflected from the image using a photosensor; and selecting one of a first mode for determining the density of the image based on an output of the photosensor when a predetermined amount of light is projected from the light source, and a second mode for determining the density of the image based on an amount of light projected from the light source when the amount of light is controlled so that the output of the photosensor has a predetermined value.

10. A method according to claim 9, wherein the image having a density which is to be measured comprises a toner image; and wherein either the first mode or the second mode is selected in accordance with a color of the toner image.

11. A method according to claim 10, wherein the selecting step selects the second mode when the toner image is black, and selects the first mode when the toner image is a color other than black.

12. A method according to claim 11, wherein the light source comprises a light-emitting diode.

* * * * *